US007552988B2

(12) United States Patent
Yamamoto et al.

(10) Patent No.: US 7,552,988 B2
(45) Date of Patent: Jun. 30, 2009

(54) DETERMINATION OF THE COMBINATION OF INK AMOUNT FOR REALIZING THE SPECIFIED COLORS

(75) Inventors: Yuko Yamamoto, Nagano-ken (JP); Yoshifumi Arai, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 583 days.

(21) Appl. No.: 11/442,372

(22) Filed: May 25, 2006

(65) Prior Publication Data

US 2006/0276978 A1 Dec. 7, 2006

(30) Foreign Application Priority Data

Jun. 2, 2005 (JP) ..... 2005-162861

(51) Int. Cl.
*B41J 29/38* (2006.01)

(52) U.S. Cl. ..... 347/19; 347/14; 347/15

(58) Field of Classification Search ..... 347/14, 347/15, 19, 43
See application file for complete search history.

(56) References Cited

U.S. PATENT DOCUMENTS

2001/0026307 A1* 10/2001 Akahira ..... 347/101

FOREIGN PATENT DOCUMENTS

JP 07-095425 4/1995

OTHER PUBLICATIONS

Abstract of Japanese Patent Publication No. 07-095425, Pub. Date: Apr. 7, 1995, Patent Abstracts of Japan.

* cited by examiner

*Primary Examiner*—Thinh H Nguyen
(74) *Attorney, Agent, or Firm*—Martine Penilla & Gencarella, LLP

(57) ABSTRACT

For correlating the specified colors and ink amount, the specified color data showing the color values of the specified colors are acquired, the ink amount data showing optional ink amount are converted into color values, evaluation index including the first evaluation index for evaluating the color difference between the color value of the specified colors under the standard observation condition and the color value of the ink amount and the second evaluation index for evaluating the color difference among color values obtained under a plurality of observation conditions are acquired, the question of whether the evaluation by the evaluation index meets the predetermined evaluation standard or not is evaluated, the conversion of the ink amount data and the acquisition of the evaluation index are repeated by correcting the ink amount until the evaluation standard is met, and the ink amount data of the ink amount having met the evaluation standard and the specified color data are correlated.

12 Claims, 8 Drawing Sheets

× : Color value of the specified color

● : Color value of the ink amount data under comparative observation conditions

○ : Color value of the ink amount data under the standard observation condition (A) Spectral Neugebauer Model $$R(\lambda)=a_w R_w(\lambda)+a_c R_c(\lambda)+\cdots+a_k R_k(\lambda)$$

$$a_w = (1-f_c)(1-f_m)(1-f_y)$$
$$a_c = f_c(1-f_m)(1-f_y)$$
$$a_m = (1-f_c)f_m(1-f_y)$$
$$a_y = (1-f_c)(1-f_m)f_y$$
$$a_r = (1-f_c)f_m f_y$$
$$a_g = f_c(1-f_m)f_y$$
$$a_b = f_c f_m(1-f_y)$$
$$a_k = f_c f_m f_y$$

(B) Marlay Davis Model $$f_c = f_{1D-LUT}(d_c)$$

(A) Cellular Yule-Nielsen Spectral Neugebauer Model (B) Ink covering ratio fc(d)

(C) Calculation of spectral reflectance Rsmp(λ)

$$\mathrm{Rsmp}(\lambda)=\left(\sum a_i R_i(\lambda)^{1/n}\right)^n$$

$$=\left(a_{11}R_{11}(\lambda)^{1/n}+a_{12}R_{12}(\lambda)^{1/n}+a_{21}R_{21}(\lambda)^{1/n}+a_{22}R_{22}(\lambda)^{1/n}\right)^n$$

$$a_{11}=(1-f_c)(1-f_m)$$

$$a_{12}=(1-f_c)f_m$$

$$a_{21}=f_c(1-f_m)$$

$$a_{22}=f_c f_m$$

$$R(\lambda)=\{a_w R_w(\lambda)^{1/n}+a_c R_c(\lambda)^{1/n}+a_m R_m(\lambda)^{1/n}+a_b R_b(\lambda)^{1/n}\}^n$$

$$a_w = (1-\mathrm{f}_c)(1-\mathrm{f}_m)$$
$$a_c = \mathrm{f}_c(1-\mathrm{f}_m)$$
$$a_m = (1-\mathrm{f}_c)\mathrm{f}_m$$
$$a_b = \mathrm{f}_c\mathrm{f}_m$$

DETERMINATION OF THE COMBINATION OF INK AMOUNT FOR REALIZING THE SPECIFIED COLORS

The entire disclosure of Japanese Patent Application No. 2005-162861, filed Jun. 2, 2005, is expressly incorporated by reference herein.

BACKGROUND OF THE INVENTION

1. Field of the Invention

The present invention is related with the art of determining the combination of ink amount for realizing the specified colors from among the combination of any optional ink amount.

2. Description of the Related Art

Printing apparatuses generally record a combination of four or more colors of ink (for example, CMYK (cyan, magenta, yellow and black)) on the recording medium to express a large number of colors. There are a plurality of combinations of ink amount required to print a color in such printing apparatuses. Therefore, a technology for determining the combination of ink amount to make the reproduced colors appear in the same colors under different light sources is known (for example, JP-A-7-95425).

In the art described above, the learning of neural network for specific light source is required, and it was difficult to learn how to make colors appear the same under any of optional light sources. In addition, it was difficult to take into account indispensable conditions (graininess and the limitation of ink amount) for the amount of ink used in printing apparatuses.

In addition, the specified colors for corporate logos and posters for which the color value is strictly determined must be reproduced with a color value determined under the standard light source and at the same time the color appearance under a plurality of light sources must be harmonized to the maximum extent possible, and there has been no technology capable of determining such a combination of ink amount.

SUMMARY

An advantage of some aspects of the invention is to provide a technology of determining the amount of ink capable of realizing reliable color reproduction under the standard light source and harmonizing to the maximum extent possible the appearance of colors under a plurality of light sources.

In order to achieve the advantage mentioned above, in the invention, the amount of ink data representing the amount of ink to be evaluated are evaluated by a first evaluation index for evaluating the color difference between the color value of the specified colors and the color value of the amount of ink under the standard observation conditions mentioned above and a second evaluation index for evaluating the color difference among the color values obtained under a plurality of observation conditions with regards to the amount of ink mentioned above. The first evaluation index enables to evaluate whether the color value obtained under the standard observation condition and the color value of the specified colors under the standard observation condition agree or not when printing is done with the amount of ink to be evaluated.

The second evaluation index enables to evaluate to what extent color values obtained under a plurality of observation conditions when printing is done with an ink amount to be evaluated agree mutually among themselves. Therefore, the evaluation of ink amount based on both the first evaluation index and the second evaluation index enables to obtain a combination of an ink amount for reproducing the specified color under the standard observation condition and an ink amount for limiting variations in the appearance of colors under a plurality of observation conditions.

Incidentally, it is enough to be able to specify the specified color from the specified color data, or specify the standard observation conditions and the color value from the same. Therefore, the specified color may be specified by color samples whose color values are specified in advance under the standard observation condition, or may be specified by process colors (CMYK), or may be specified by a sRGB value or a calibrated RGB value. In other words, whatever may be the mode of specification, it is enough to be able to specify color value under the standard observation condition for any specific color.

It is enough that the ink amount data converting unit obtains the color value resulting from printing based on any optional ink amount. For example, it is possible to adopt a conversion model for obtaining a spectral reflectance by simulating the recorded state of ink on the recording medium and for calculating a color value based on this spectral reflectance. More specifically, the way ink is recorded on the recording medium by the ink amount data showing optional ink amount may be simulated to obtain the spectral reflectance. Once the spectral reflectance has been obtained, it is possible to calculate the color value under an optional light source by specifying the spectral distribution of the optional light source. Therefore, a conversion model may be generated in advance for this simulation.

Incidentally, the color value may be color component values in instrument independent color space, and L*a*b* value, L*u*v* value, XYZ values and the like may be adopted. And it is enough that ink amount data enable to specify the amount of ink used for each color used in the printing apparatus. For example, it is possible to adopt a combination of gradation values for each ink color. As the invention can be applied when a plurality of combinations of ink amount are available for expressing specified color, the ink amount is for each of four or more colors. And there is no special limitation for the color of ink.

It is enough that the first evaluation index enables to evaluate the color difference between the color value of the specified color under the standard observation condition and the color value of the ink amount obtained by the ink amount data converting unit mentioned above (color value under the standard observation condition). And with regards to the second evaluation index, it is enough that the color difference among the color values obtained under a plurality of observation conditions for ink amounts indicated by the ink amount data may be evaluated thereby.

In such first evaluation index and second evaluation index, it is possible to adopt functions whose value varies depending on the magnitude of the color difference as evaluation index and to adopt a structure of evaluating the color difference by the magnitude of the index value. Obviously, in the invention, the ink amount data to be evaluated by the first evaluation index and the second evaluation index are the same ink amount data, and the adoption of this structure enables the result of printing by some ink amount data to realize reliable reproduction of color under the standard observation condition and to evaluate whether the appearance of color under a plurality of observation conditions agrees or not.

Incidentally, in order to constitute an evaluation index with a function, it is preferable to constitute the ink amount data converting unit mentioned above by a conversion model for acquiring color values based on the ink amount. In other words, this structure enables to calculate the evaluation index by a predetermined formula based on the ink amount, and to evaluate automatically the ink amount. In addition, the number of observation conditions to be adopted in the second evaluation index is not specially limited, and it is enough that the observation conditions may be evaluated for restricting differences in the appearance of colors. Obviously, proportionately in parallel with an increase in the number of observation conditions, it will be easier to obtain a combination of ink amounts limiting variations in the appearance of colors due to changes in the observation conditions.

It is enough that the ink amount correcting unit can repeat the evaluation with the evaluation index mentioned above and the correction of ink amount. In other words, by generating in advance the standard for evaluating with evaluation index and by repeating correction and evaluation until the evaluation relating to certain ink amount data meets this standard, it will be possible to bring the ink amount data gradually close to the ideal data (ink amount that realizes reliable color reproduction under the standard observation condition and harmonizes the appearance of colors under a plurality of observation conditions).

As a structure for this, it is possible to adopt an optimization calculation having evaluation index as the target functions. For this optimization calculation, it is possible to adopt known methods such as the Annealing Method, the Simplex method, the Quasi Newton Method, the Conjugate Gradient Method, and the like. In addition, it is enough to adopt as the evaluation standard a standard for determining whether the ink amount data are adequate or not as data for printing the specified color, and a threshold value for example may be set in advance for comparing with the evaluation index value.

Whether the evaluation by evaluation index meets the predetermined evaluation standard, the specified color is outputted by printing based on the ink amount data, and the color is in a state unlikely to change due to changes in the observation condition. Therefore, the ink amount data may be correlated as the data for printing the specified color data. Obviously, the specified color is not limited to one and there may be a plurality of colors. For printing the specified colors determined in advance such as those contained in corporate logos or posters, the application of the invention to all the colors contained in such logos and posters enables to print logos or posters having a very high color reproducibility and unlikely to be affected by the observation conditions.

In the invention, the evaluation index enable to determine the features of the ideal ink amount data and it is possible to determine the evaluation index in such a way that evaluations may be made other than those conducted by the first evaluation index and the second evaluation index mentioned above. For example, as the image quality of printed result is affected by the graininess resulting from the separation of ink drops for recording, the graininess index for evaluating graininess may be introduced to contain the feeling of graininess.

It is enough that graininess can be evaluated by this index. For example, the state of recording in the case of ink recording based on ink amount data may be simulated, and an index for evaluating the space frequency of the simulation result may be used. This index enables to quantify the graininess of dots and noise in the printed matters, and enables to evaluate graininess without resorting to actual printing.

And it is possible to introduce the ink amount limit at index for evaluating whether the ink amount limit is met or not as an evaluation index. In other words, when a large quantity of ink is used for recording on the recording medium, the recording medium bends or the ink gets blurred resulting in the degradation of image quality. Accordingly, the definition of the ink amount per unit area or the upper limit of ink used as an evaluation index enables to select a desirable combination of ink amount within the limit of limitation of ink amount. The limitation of ink amount can be defined by a variety of methods. It may be defined for each color of ink, or the ink amount limitation may be defined for the total sum of a plurality of ink colors.

In the invention, it is enough if the evaluation index can be defined in such a way that the ink amount data may be chosen for realizing the reproduction of reliable color under the standard light source and the color appearance may be harmonized to the maximum extent possible under a plurality of light sources. However, in the invention, when it is extremely important to print with the specified color for corporate logos or posters, the ink amount data for outputting the specified color are obtained. Therefore, it is preferable to define the evaluation index so that an importance may be given to the concordance with the specified color.

A specific structure that may be adopted for this purpose is a structure in which the degree of contribution to the evaluation index may be different between the first evaluation index and the second evaluation index, and on top of that the first evaluation index contributes more than the second evaluation index. In other words, if the concordance of color under the standard observation conditions evaluated by the first evaluation index and the concordance of color under a plurality of observation conditions evaluated under the second evaluation condition are continuously evaluated with the same weight, it is possible that the ink amount for outputting a color agreeing with the specified color under the standard observation condition may be hardly obtained even if the correction of the ink amount data may be repeated many times.

And, even if a high evaluation may be obtained for the whole evaluation index as a result of optimization by the optimization calculation mentioned above, it is possible that ink amount data for outputting colors having a low degree of concordance with the specified color under the standard observation condition may be obtained. Therefore, the adoption of a structure in which the contribution by the first evaluation index is greater than by the second evaluation index enables to obtain ink amount data for outputting having a high degree of concordance with the specified color. Incidentally, the contribution for each evaluation index may be adjusted by the weight coefficient of each evaluation index.

Furthermore, it is possible to adopt a structure in which the contribution of the first evaluation index grows larger as the number of correction increases when the correction by the ink amount correcting unit is repeated. According to this structure, it will be possible to extract without fail ink amount data that would make the evaluation by the first evaluation index high. Incidentally, when the evaluation index is gradually increased, it is preferable to adopt a structure that the evaluation by the first evaluation index may contribute most importantly to the evaluation result at the stage where the evaluation index meets the evaluation standard. For example, a normal number of correction may be measured in advance and after making such a number of correction, the contribution by the first evaluation index may be set to be the maximum.

Obviously, as it is possible to adjust the contribution of the evaluation index by the weight coefficient here, according to this structure, a structure of changing the weight coefficient depending on the number of correction may be adopted. As it is possible to adjust the relative contribution for each evaluation index by adjusting the weight for the evaluation index, the weight for the first evaluation index may be increased in response to the number of corrections, and the weight of the second evaluation index may be decreased in response to the number of corrections, or both may be carried out.

And as a preferable example of structure when the ink amount data converting unit mentioned above is realized by the conversion model mentioned above, a structure of verifying whether the ink amount data meeting with the evaluation standard in the evaluation index are adequate or not may be adopted. For example, when the printing apparatus is made to print patches based on the ink amount data correlated by the ink amount determining unit and a plurality of ink amount data in which the ink amount represented by the correlated ink amount data has been changed by a predetermined amount, a plurality of patches of the specified color or close to the specified color will be printed.

Then, when the colorimetric value resulting from the measurement of color of these patches by a colorimeter is obtained and when it is compared with the color value of the specified color, it will be possible to judge whether the specified color could be printed by the ink amount data mentioned above. If the specified color based on the ink amount data mentioned above is printed, it will no longer be necessary to correct the correlation determined by the ink amount determining unit mentioned above, and if there are patches printed more closely to the specified color among a plurality of patches, the ink amount data may be obtained and used as the ink amount data for printing the specified color.

Incidentally, here patches are printed based on the ink amount data correlated by the ink amount determining unit and a plurality of ink amount data in which the ink amount represented by the correlated ink amount data has been changed by a predetermined amount, and in some cases the ink amount data of which the ink amount is changed by a predetermined amount will be adopted. Therefore, it is preferable to change the ink amount within a limit not causing great changes in the appearance of color under a plurality of observation conditions by a change in the ink amount.

In other words, if it is possible to adopt ink amount data having a high degree of concordance with the specified color under the standard observation condition by changing the ink amount within a very narrow range, the ink amount data will be chosen. In order to make such a choice, the ink amount may be varied within a predetermined very narrow range (for example, color gradation value ±1). Obviously, if ink amount data having a high degree of concordance with the specified color cannot be chosen by making very small changes, the range of variation of the ink amount may be increased, or further corrections may be made by the ink amount correcting unit mentioned above.

And, as a structure for determining adequate ink amount data by repeating the corrections by the ink amount correcting unit, the structure of choosing ink amount data for outputting color as close to the specified color as possible as the initial value of the ink amount data for evaluation may be adopted. As this structure enable to start the correcting work of ink amount by choosing the ink amount data close to the ink amount data meeting with the evaluation standard as the initial value, it will be possible to determine the ink amount data meeting with the evaluation standard by making a small number of corrections.

As more specific structure, it is possible to adopt a structure of converting a plurality of ink amount data into color value by the ink amount data converting unit mentioned above and of obtaining the data closest to the color value of the specified color from among such ink amount data as the initial value. At this time, a predetermined area containing the color value of the specified color may be designated in the instrument independent color space, the ink amount data contained in this area may be extracted, and the color value of each ink amount data and the color value of the specified color may be compared. Obviously, these color values are color values calculated under the standard observation conditions.

In other words, as it is unknown what ink amount data are close to the color value of the specified color at the stage of extracting a plurality of ink amount data, the color value may be calculated for a plurality of ink amount data extracted at random and the color value of the ink amount data contained in the predetermined area among such data may be compared with the specified color. For extracting a plurality of ink amount data, it is possible to adopt data resulting from an optional combination of values obtained by dividing equally the gradation value of each ink color. For the predetermined area within the instrument-independent color space, it is enough if an area of the predetermined expanse containing the specified color can be defined in advance.

The structure mentioned above is particularly useful for the structure in which the correction of ink amount and the evaluation of the evaluation index are repeated as a result of optimization calculation. In other words, an unnecessarily large number of calculations are required unless the initial value of ink amount data is determined in the optimization calculation. However, the appropriate selection of initial values enables to end the optimization calculation in a very limited number of times. And even in the absence of findings on the ink amount data for outputting a color close to the specified color, appropriate initial values can be easily chosen.

In the invention, as ink amount data suitable for realizing the reliable reproduction of color for the specified color under the standard light source and for harmonizing the appearance of color under a plurality of light sources to the maximum extent possible can be selected, the evaluation of a plurality of specified colors by the evaluation index enables to generate color conversion profile data correlating the plurality of specified colors and the ink amount data. Obviously, these color conversion profile data can be used as a profile for converting any optional color, and profile data for converting any optional color may be generated by carrying out interpolating calculations by referring these color conversion profile data.

Obviously, the invention described above can be realized not only by apparatuses but also by methods, and can be realized by programs that carry out the processing performed by the apparatus mentioned above. In addition, it can be realized as print controlling apparatus, method or program for executing printing based on the ink amount data correlated with the specified color mentioned above. And the apparatus, method, and program relating to the invention may be executed alone, or may be executed together with another apparatus, method, or program being incorporated in an equipment, and the philosophy of the invention is not limited to these, may include a variety of modes and therefore is variable as required.

And, the program of the invention may be provided on a recording medium. The recording medium of this program may be a magnetic recording medium or a photomagnetic recording medium. And whatever recording medium that may be developed in the future can be considered exactly in the same way. And as for the level of reproduction such as the primary reproduction or the secondary reproduction, there is no room for questioning and they are completely the same. In addition, in the case where the invention is realized partly in software and partly in hardware, the invention philosophy does not change at all. It may be partly stored on the recording medium to be read out from time to time as required. And all the functions need not be realized on a single program and may be realized on a plurality of programs. In such a case, each function may be realized by a plurality of computers.

DETAILED DESCRIPTION

Here, we will describe the embodiments of the invention according to the following order.

Figure 1:
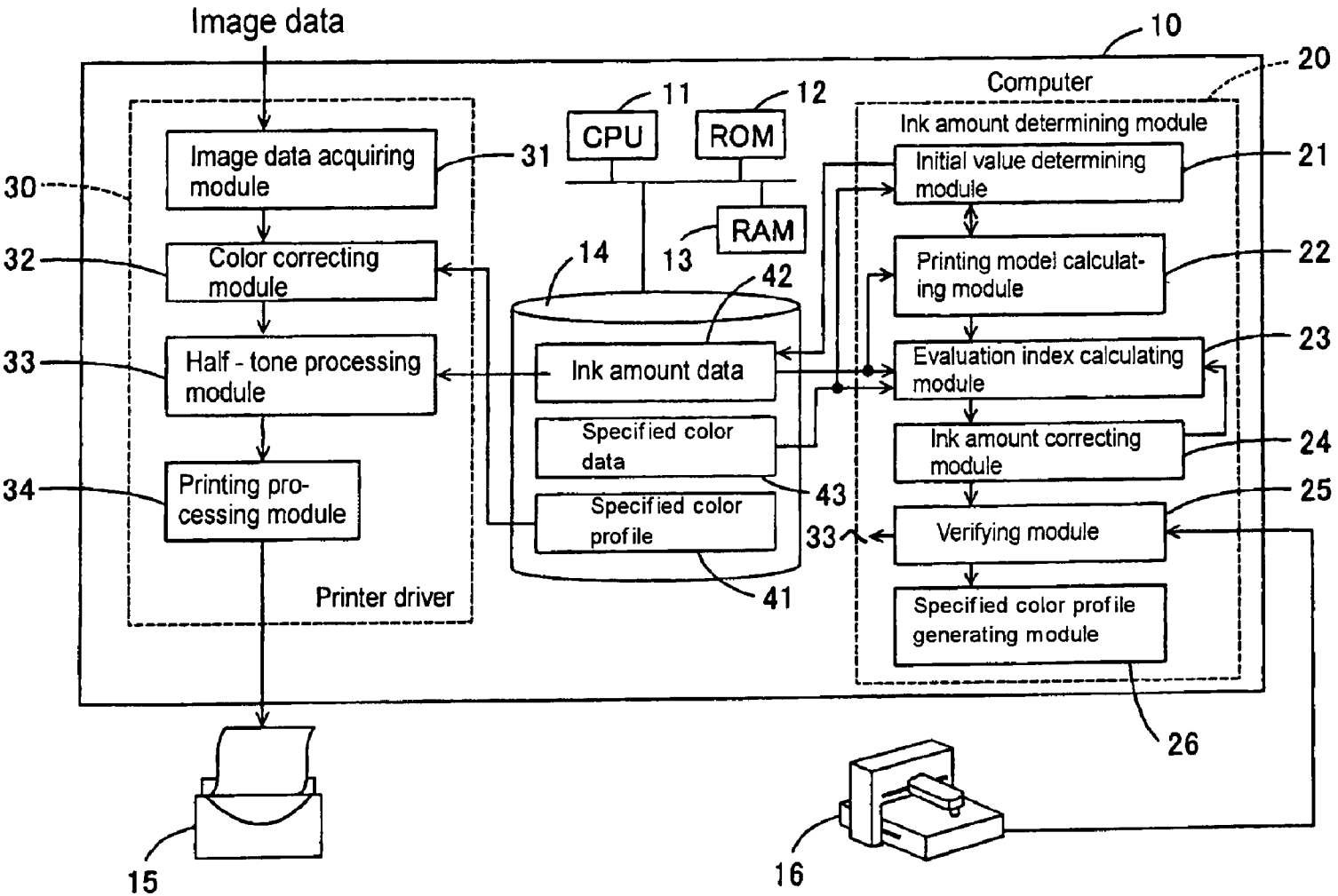
FIG. 1 is a block diagram showing the structure of an ink amount determining apparatus and a print controlling apparatus.

(1) Outline of the ink amount determining apparatus and the print controlling apparatus (2) Print controlling processing (3) Ink amount determining processing (4) Printing model (5) Other embodiments (1) Outline of the Ink Amount Determining Apparatus and the Print Controlling Apparatus FIG. 1 is a block diagram showing the hardware structure and the software structure of the print controlling apparatus for determining the ink amount to be correlated with the specified color and for printing according to this ink amount. The apparatuses relating to the present embodiment can be formed by any general-purpose computer. Needless to say, the computer executing the ink amount determination and print controlling mentioned above may be a separate computer.

The computer 10 includes a CPU 11 constituting the nucleus of computing processing, and this CPU 11 controls the whole computer 10 through a system bus. The system bus is connected with a ROM 12, a RAM 13, a hard disk 14 or a USB I/F, CRT I/F or an input device I/F not shown.

The hard disk 14 stores software programs such as an operating system (OS), an ink amount determining program 20 for generating a color conversion table, a printer driver (PRTDRV) 30 for printing images and the like. These software programs are transferred as required to the RAM 13 by the CPU 11 at the time of execution. The CPU 11 executes various programs under the control of the OS by accessing the RAM 13 as required as a provisional work area.

The input device I/F is connected with a keyboard and a mouse not shown as operating input devices. And the CRT I/F is connected with a display for displaying images. Therefore, the computer 10 can receive the contents of operation by the keyboard and mouse and display a variety of information on the display device. And the USB I/F is connected with the printer 15 and can print images based on the data outputted by the computer 10.

The USB I/F is connected also with a calorimeter 16, and the computer 10 obtains colorimetric values (color values) measured by the calorimeter 16. Specifically, the colorimeter 16 irradiates the printed matter with a light source whose spectral reflectance is known, detects the reflected light to detect the spectral reflectance of the printed matter, and outputs the color value of the same to the computer 10. Obviously, the connection I/F with the printer 15 needs not to be limited to the USB I/F, a variety of connecting mode such as parallel I/F, serial I/F, SCSI connection and like can be adopted, and whatever connecting mode that may be developed hereafter will have the same effect.

We will describe below the processing required for operating the computer 10 mentioned above as the print controlling apparatus relating to the invention. The computer 10 obtains image data used by a variety of image devices such as scanner, digital still camera, image input device or display of a video camera, image output device of a projector and the like, converts color by referring the color conversion table and prints by means of a printer 15. At this time, the computer 10 obtains the ink amount data specifying the ink amount to be used on the printer 15 from the image data by referring a color conversion table not shown. However, in the invention, for printing the specified colors, the computer 10 refers the specified color profile 41 for the specified color.

(2) Processing for Print Controlling

At any rate, as printing is executed by resorting to such a color conversion, the computer 10 according to the present embodiment has a printer driver 30. The printer driver 30 has an image data acquiring module 31, a color correcting module 32, a half-tone processing module 33 and a printing processing module 34. The image data acquiring module 31 is a module for acquiring image data showing the image to be printed. The image data acquiring module 31 converts definition to adjust the number of pixels of the image data acquired and the number of pixels required for printing when they do not conform each other. The color correcting module 32 is a module for converting the color system of image data by executing interpolating calculations by referring the color conversion table not shown stored in the hard disk 41 or by referring the specified color profile 41 for conversion, and converts the color system by obtaining image data from the image data acquiring module 31.

In the present embodiment, image data are data specifying the color for each pixel by the sRGB color system, and the data after color conversion are the ink amount data (CMYKlclm data) corresponding to the ink amount of each color CMYKlclm. In other words, the printer 15 according to the present embodiment can load each of ink colors CMYKlclm, and the color of each pixel is designated in the ink amount data by specifying the ink amount of each color by gradation value. The color conversion table is a table for converting the color system sRGB into color values, and for converting these color values into the ink amount data of the color system CMYKlclm.

The specified color profile 41 represents data correlating color values and ink amount data, and the color correcting module 32 refers the specified color profile 41 when the color values specified in the specified color profile 41 are obtained after converting the image data of the color system sRGB. Therefore, conversions based on the specified color profile 41 will be made when the specified colors are contained in the image data, and printing will be executed. Needless to say, in the invention, for printing the specified colors, the only requirement is that printing can be executed by the ink amount determined by the ink amount determining program 20, and the specified colors may be specified by the color system sRGB data, and the format of the specified color profile 41 is not limited to the one mentioned above.

When the color correcting module 32 converts a color and generate ink amount data, the ink amount data are delivered to the above-mentioned half-tone processing module 33. The half-tone processing module 33 is a module for half-tone processing for obtaining half-tone data specifying the presence or absence of the record of ink drops for each pixel by converting the CMYKlclm gradation value of each pixel.

Upon receipt of such half-tone data, the printing processing module 34 rearranges the data in the order they will be used in the printer 15. In other words, the printer 15 has a jet nozzle array not shown as an ink jet device. As the jet nozzle array arranges in parallel a plurality of jet nozzles in the auxiliary scanning direction, data separated by several dots are used simultaneously in the auxiliary scanning direction. Accordingly, a rearranging processing is carried out for rearranging the data that should be used at the same time among those arranged in the main scanning direction in such an order that they may be buffered simultaneously in the printer 15. After this rearranging processing, the printing processing module 34 generates printing data by adding the predetermined information such as the definition of images, and output the same to the printer 15. The printer 15 prints the images shown by the image data described above based on the printing data to obtain the output images.

(3) Ink Amount Determining Processing

According to the present embodiment, the computer 10 constituting the print controlling apparatus has an ink amount determining program 20, and the user executes the ink amount determining program 20 and generates a specified color profile 41 before proceeding to the printing of images containing the specified colors. The ink amount determining program 20 includes an initial value determining module 21, a printing model calculating module 22, an evaluation index calculating module 23, an ink amount correcting module 24, a verifying module 25 and a specified color profile generating module 26.

Figure 2:
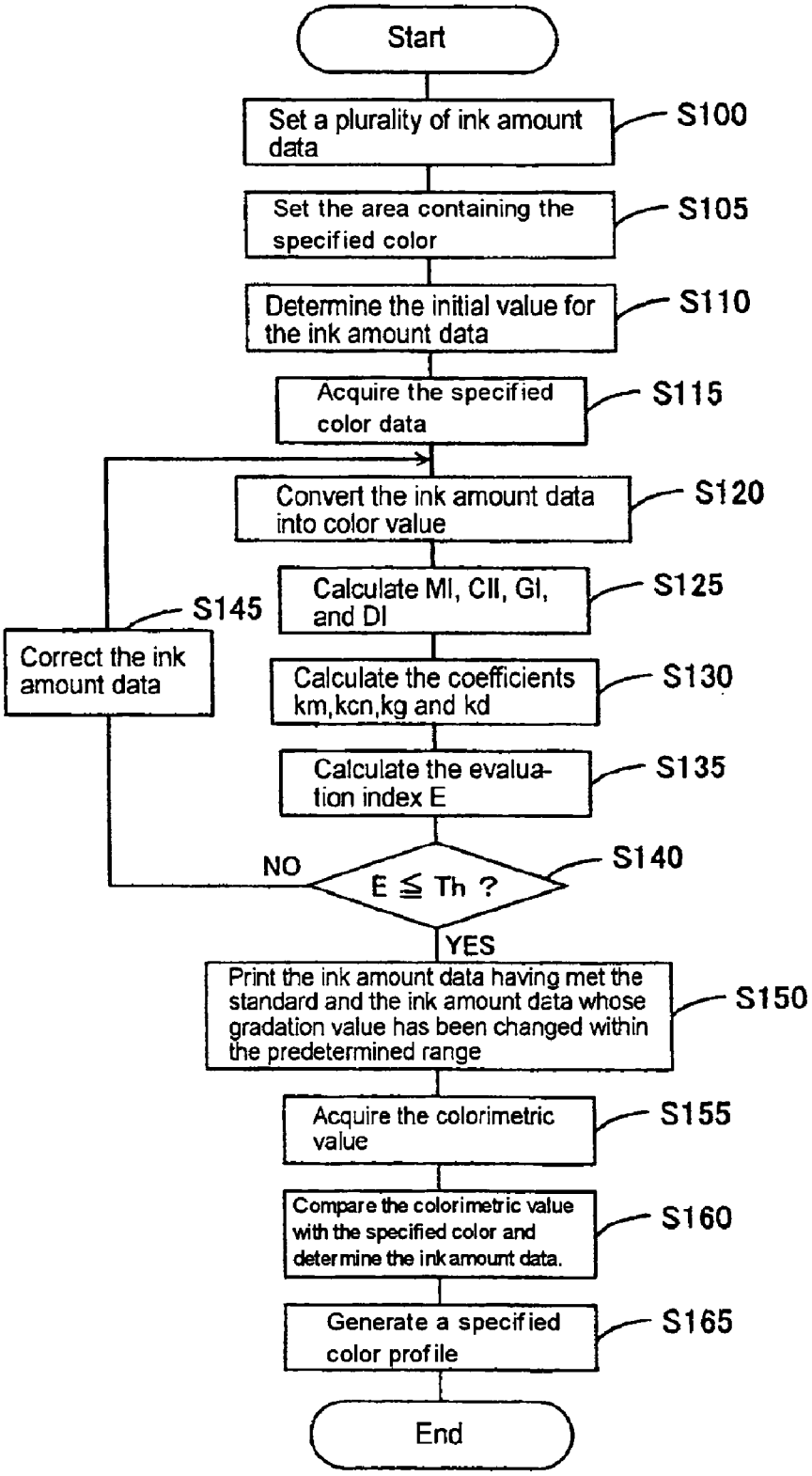
FIG. 2 is a flowchart of the ink amount determining process.

FIG. 2 is a flowchart of ink amount determining processing, and in the present embodiment the ink amount data are renewed by executing an optimization processing that takes the evaluation index calculated by the evaluation index calculating module 23 as the target function and determines the ink amount data meeting the evaluation standard. For starting this optimization processing, it is preferable to choose data as close as possible to the ink amount data meeting the evaluation standard as the initial value, and the initial value determining module 21 executes a processing to determine the initial value of ink amount data.

More specifically, as the precise color value of images obtained by printing based on ink amount data cannot be known only on the basis of the ink amount data, a plurality of appropriate ink amount data are set as candidates for initial values (step S100). For example, a plurality of ink amount data are set by dividing evenly the gradation value area of CMYKlclm data by a predetermined interval and by combining the color gradation values obtained thereby.

Figure 3:
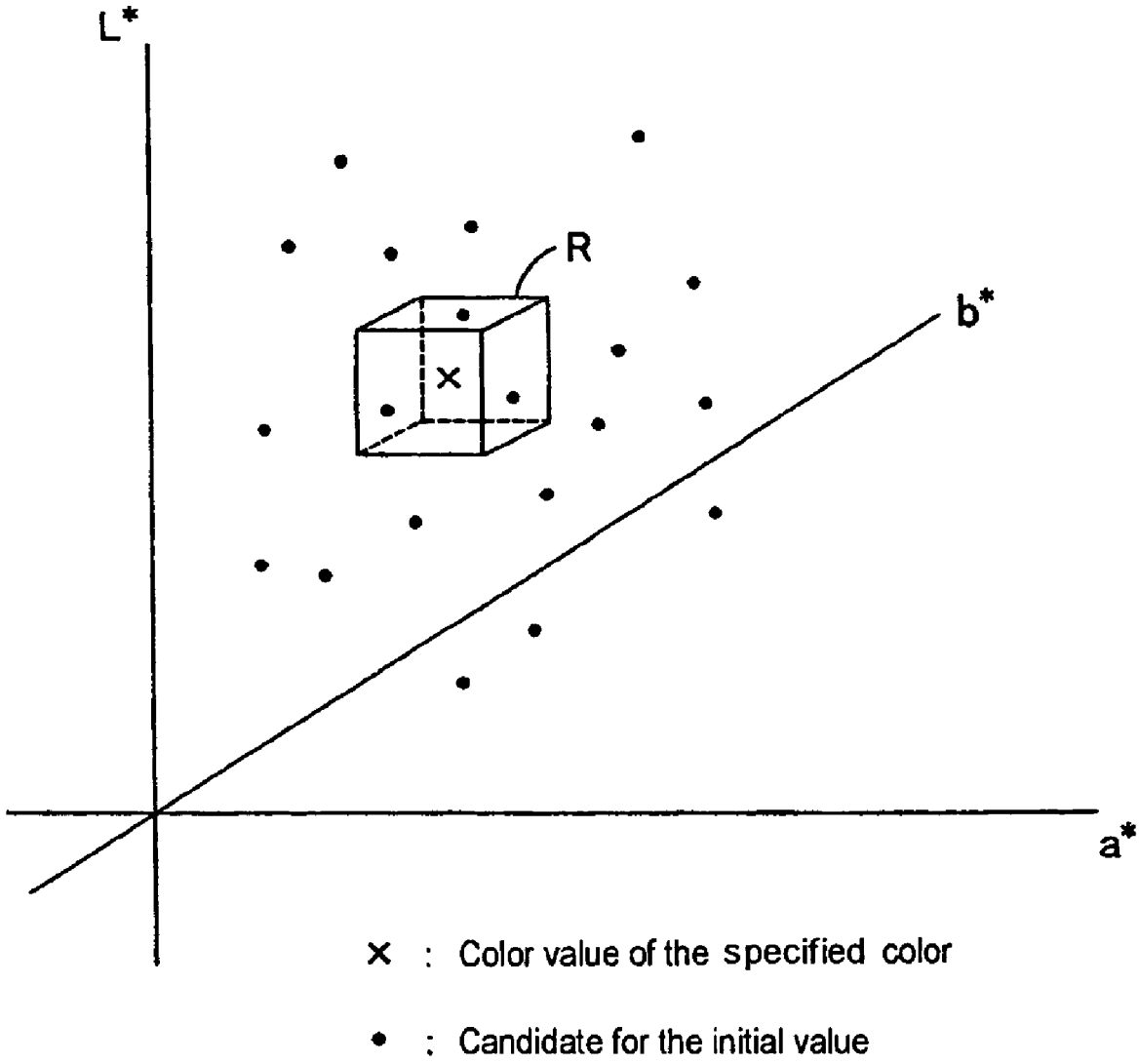
FIG. 3 is a descriptive illustration of how the initial values are determined.

On the other hand, the specified color data 43 showing the color values of the specified colors (for example, L*a*b* value) are recorded in advance on the hard disk 14, and the position of instrument independent color space (for example, L*a*b* space) corresponding to the color values of the specified colors can be specified by these specified color data 43. Accordingly, the initial value determining module 21 obtains the specified color data 43 and generates data showing the predetermined area R centered around the color values of the specified colors to set the area R (step S105). FIG. 3 shows a instrument independent color space—where the color value of the specified color is X and the predetermined area R is a cube.

The printing model calculating module 22 is a module for converting a plurality of ink amount data into color values under an optional observation condition by the model described further below, and at the time of determining the initial value, the module converts each of the ink amount data set in the step S100 by the above-mentioned initial value determining module into the color values under the standard observation conditions. As the color values obtained can be plotted in the instrument independent color space like black circles shown in FIG. 3, the extraction of nothing but black circles contained in the predetermined area R mentioned above enables to obtain the ink amount data by which color values close to the color values of the specified colors can be printed.

Accordingly the color difference between the color value of the ink amount data extracted and the color value of the specified colors is respectively calculated, and the ink amount data showing the color value of the minimum color difference is determined as the initial value (step S110). In other words, the comparison of only the color value of the ink amount data contained in the predetermined area R with the color value of the specified color enables to obtain the ink amount data having the color value closest to the color value of the specified color by only a limited number of comparisons. Incidentally, the standard observation condition here is an observation condition predetermined when the color value of the specified color was specified.

The ink amount data determined as described above are recorded on the hard disk 14 (ink amount data 42), and the printing model calculating module 22, the evaluation index calculating module 23 and the ink amount correcting module 24 repeat correcting ink amount and evaluating by means of the evaluation index to optimize the ink amount data. At this time, a combination of ink amount resulting in the minimum possible color difference with the color value of the specified color under the standard observation condition, in the minimum possible color difference under a plurality of observation conditions, in the minimum possible graininess and meeting the limitation of ink amount will be the optimum ink amount data.

For this purpose, in the present embodiment, the evaluation index E is defined by the following equation (1):

[Equation 1]

$$E = k_m \cdot MI + \sum_{n=1}^{N} k_{cn} \cdot CII_n + k_g \cdot GI + k_d \cdot DI \tag{1}$$

Here, MI (Metameric Index) means the color difference between the color value of the specified color under the standard observation condition and the color value when the color value of the ink amount data is calculated for the standard observation condition, and km is the coefficient for adjusting the degree of contribution to the evaluation index E. CII (Color Inconstancy Index) is the color difference between the color value of the ink amount data under the nth (n is an integer equal to 1 or more and N or less) observation condition and the color value of the ink amount data under the standard observation condition, and kcn is the coefficient for adjusting the degree of contribution of the nth CII to the evaluation index E. Regardomg MI, see Billmeyer and Saltzman's Principles of Color Technology, 3$^{rd}$ Edition, John Wiley & Sons, Inc., 2000, p. 127, and regarding CII, see Billmeyer and Saltzman' s Principles of Color Technology, 3$^{rd}$ Edition, John Wiley & Sons, Inc., 2000, p. 129.

Incidentally, CII in the present embodiment represents the color difference between the color value under the standard observation condition and the color value under other observation conditions. However, since all that is required here is that the appearance of color under various observation conditions can be evaluated, an equation for calculating the color difference between optional two pairs under a plurality of observation conditions will do. As for the nth observation condition, any one that is determined in advance will do, and an optional observation condition can be adopted. For example, the observation condition may be defined by assuming an optional light source defined by the CIE.

Figure 4:
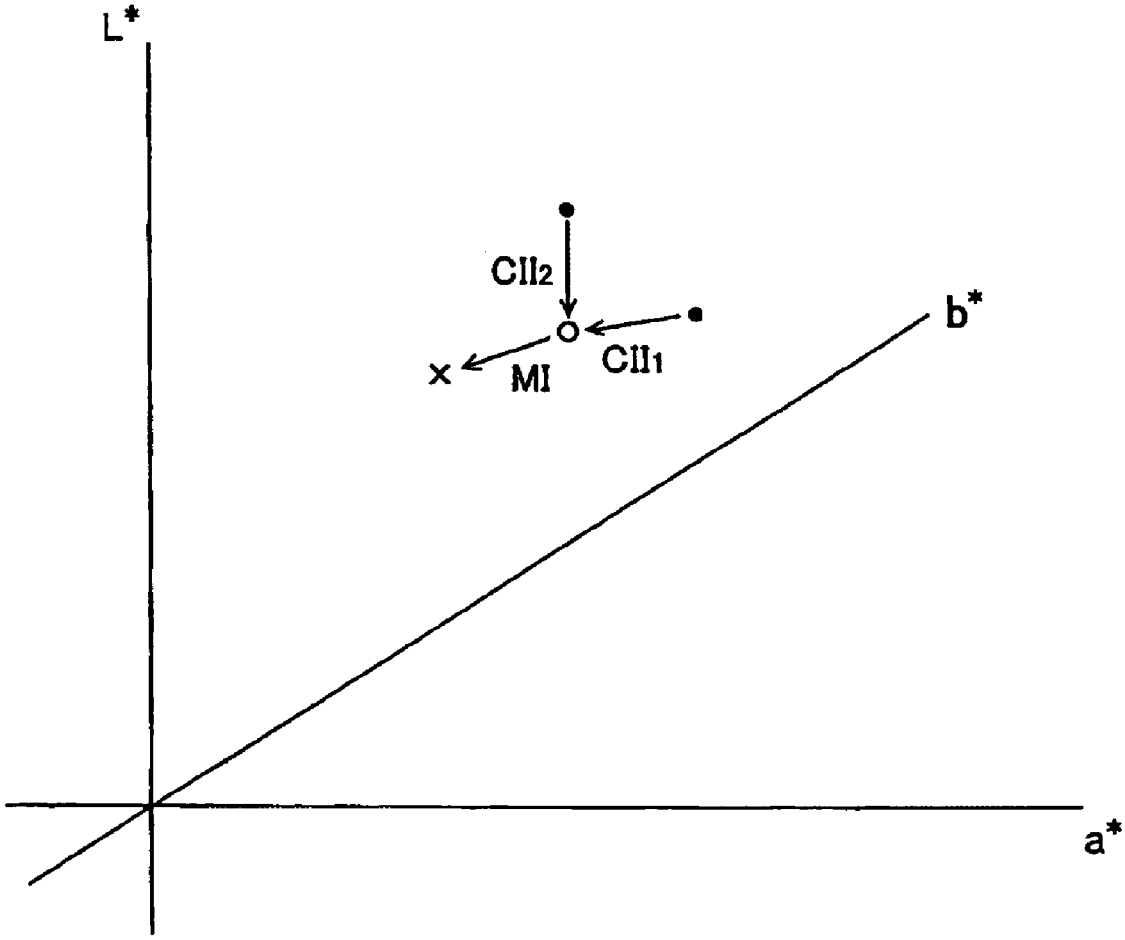
FIG. 4 is a descriptive illustration describing MI and CII.

FIG. 4 is a descriptive illustration for describing MI and CII. The figure shows the color value of the specified color and the color value obtained from the ink amount data in a instrument independent color space. In other words, the color value of the specified color defined as a color under the standard observation condition is shown by X, the color value under the standard observation condition obtained by converting the ink amount data is shown by a white circle, and the color values under the other observation conditions are shown by black circles.

As MI represents the color difference between the color value represented by X and the color value represented by a white circle, the diminution of this color difference brings the color value resulting from the printing based on the ink amount data close to the color value of the specified color. Therefore, it will be possible to execute evaluations intended to bring the output color by the ink amount data closer to the specified color by endeavoring to lower the evaluation index E to zero or the lowest possible value above zero to realize thus the optimum state. As CII represents the color difference between the color value represented by a white circle and the color value represented respectively by black circles, the diminution of this color difference reduces variations in the appearance of color even if the observation conditions may change. Therefore, it will be possible to execute evaluations intended to limit the dependence of the output color by the ink amount data to the observation conditions by endeavoring to lower the evaluation index E to zero or the minimum possible value above zero and to realize thus the optimum state.

And GI (Graininess Index) represent an index for evaluating the graininess of ink recorded by the ink amount data, and is expressed for example by the following equation (2).

[Equation 2]

$$GI=a_L\int\sqrt{WS(u)}\cdot VTF(u)du \tag{2}$$

In this equation, aL represents brightness correcting term, WS represents Wiener Spectrum, VTF represents Visual Spatial Frequency, and u represents Spatial Frequency. And kg represents the coefficient for adjusting the contribution of GI to the evaluation index E. Although the Equation (2) is a one-dimensional representation, it is easy to calculate, as the function of the space frequency u and v, the spatial frequency of two-dimensional image.

For details on GI, see for example Makoto Fujino, Image Quality Evaluation of Inkjet Prints, Japan Hardcopy '99, p. 291-294. Incidentally, GI represents graininess (or extent of noises) felt by the observer when the observer looks at a printed matter, and the smaller GI gets, the smaller graininess felt by the observer gets. Therefore, it will be possible to make evaluation for containing graininess by endeavoring to lower the evaluation index E to zero or the minimum possible value above zero and to realize thus the optimum state. Obviously, all that is required for GI is that it should be an index for evaluating graininess when images are printed, and other equations can also be used.

DI (Duty Index) is an index for ensuring that the printed result is within the limitation of the ink amount. It is an index whose value grows larger as the ink amount increase. For example, when the total sum of gradation value of all the ink colors is represented by DI, the evaluation value grows larger (evaluation falls down) as the ink amount increases, and the execution of optimization processing for lowering this evaluation index E to the minimum extent possible enables to calculate the ink amount data within the limit of ink amount. Therefore, it is possible to execute evaluations for containing the ink amount within the limit by adopting the state where the evaluation index E is reduced to zero or the minimum possible value above zero as the optimum value. Obviously, the limit of ink amount may be defined by the total sum of all the colors and the limit of ink amount may be defined respectively for one color through all the colors. Incidentally, kd is a coefficient for adjusting the degree of contribution of DI to the evaluation index E.

In order to evaluate ink amount data by this evaluation index, the evaluation index calculating module 23 acquires in the first place the specified color data 43 from the above-mentioned hard disk 14 (step S115). And the printing model calculating module 22 converts the ink amount data into color values by using the model described down below (step S120). Incidentally, here color values under the standard observation conditions and the plurality of observation conditions are acquired from the spectral reflectance resulting from printings that may be conducted by the ink amount data. And in the present embodiment, ink amount data are optimized by repeating the loop described in steps S120-S145, and the ink amount data to be converted in the step S120 is the initial value calculated in the step S110 in the first loop, and a value corrected in the step S145 for and after the second loop. As described above, in the present embodiment the step S115 corresponds to the specified color data acquiring unit mentioned above, and the step S120 corresponds to the ink amount data converting unit mentioned above.

Having acquired the necessary color value with regards to the ink amount data in the step S120, the evaluation index calculating module 23 calculates MI, CII, GI, and DI in the Equation (1) mentioned above (step S125), calculates the coefficients km, kcn, kg, and kd (step S130), and calculates the evaluation index E (step S135). The ink amount correcting module 24 judges whether this evaluation index E is below the predetermined threshold value Th or not (step 140), and corrects the ink amount data 42 recorded on the hard disk 14, when the evaluation index E is not judged to be equal to or below the threshold value Th (step S145). Thus, in the present embodiment, the steps S125-S135 correspond to the evaluation index acquiring unit, and the steps S140 and S145 correspond to the ink amount correcting unit.

When the ink amount data have been corrected, the processing of the step S120 and thereafter is repeated by using the corrected ink amount data, and when the evaluation index E has become equal to or has fallen below the threshold value Th, the processing of the step S150 and thereafter is executed considering that the ink amount has been optimized. For the correction of the ink amount data, a variety of optimizing methods can be adopted. In other words, in view of the fact that the evaluation index E is the function of the ink amount data, the evaluation index E may be gradually lowered by the optimizing method of correcting the ink amount data and finally the ink amount data can be optimized. Obviously, here the processing for minimizing the evaluation index E by using the derivative coefficient of the evaluation index E may be used.

Figure 5:
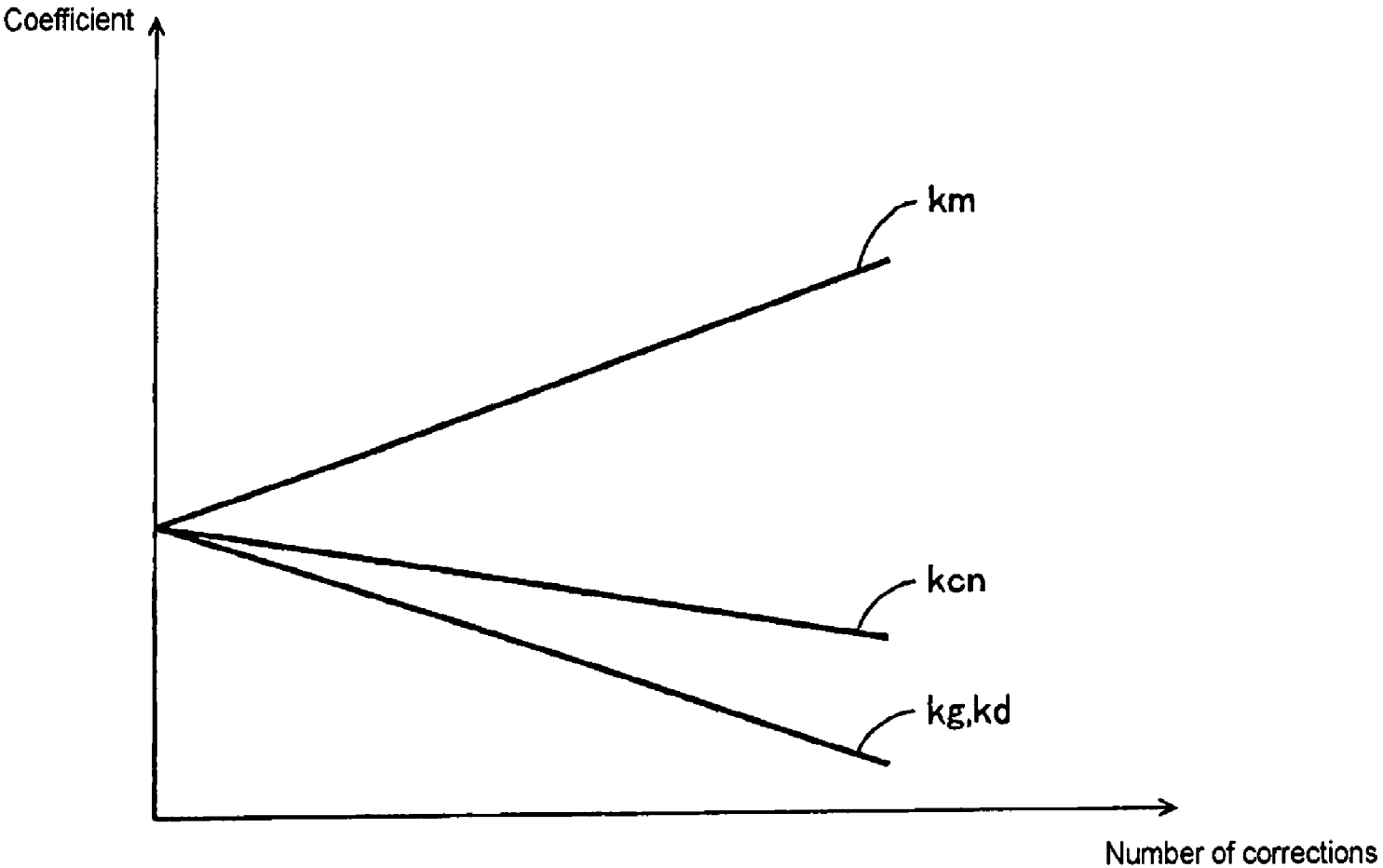
FIG. 5 is a graph showing the relations between coefficients and number of corrections.

Incidentally, the present embodiment adopts a structure of ensuring that ink amount data having a high degree of concordance with the color value of the specified color would be calculated by changing the coefficients km, kcn, kg, and kd above as the number of corrections increases. FIG. 5 is a graph showing the relationship between these coefficients and the number of corrections. As the figure shows, the coefficient km of MI gradually increases as the number of corrections increases. The coefficients kcn, kg, and kd of CII, GI and DI decreases as the number of corrections increases. And the relationship among various coefficients is km>kcn>kg (and kd).

In other words, as the number of correction of the ink amount data increases, the contribution to the evaluation index E will be the maximum in the case of MI, and the color value of the printed result based on the ink amount data after optimization more or less agrees with the color value of the specified color. Obviously, as the evaluation index E includes CII, the appearance of color under different observation conditions agrees more or less. However, it is possible to ensure that the color value of the printed result based on the optimized ink amount data agrees more or less with the specified color by making the coefficient of MI larger than the coefficient of CII. And in the optimization processing, the ink amount data vary largely generally during several rounds immediately after starting the processing. However, as the number of corrections increases, the amount of variation of the ink amount data diminishes.

As CII, GI, and DI rarely vary largely in response to miniscule changes in the ink amount data, the choice of a high value for each of the coefficients kcn, kg and k at the initial phase of the optimization processing as compared with the final phase of the optimization processing enables to choose the ink amount data whose evaluation in terms of CII, GI, and DI will be high at the initial phase of the optimization processing. Even if the value of these coefficients may be relatively low in the correction of ink amount that follows, corrections may be carried out while the evaluation of CII, GI and DI remains high. On the other hand, in the case of printing corporate logos and posters having specified colors whose color values are strictly determined, the ink amount data enabling to obtain an output as close as possible to the color value of the specified color by making a very small correction of the ink amount. Therefore, the choice of a high value for the coefficient km ensures that the user who use the specified color would obtain the ink amount data meeting the object of the user.

In the step S140, when the evaluation index E is found to be equal to or below the threshold value Th, a printing for verifying that the printed results by the ink amount data obtained are optimum will be carried out (step S150). In other words, the verifying module 25 acquires the ink amount data that gave an evaluation index E equal to or below the threshold value Th (that met the standard), and generates ink amount data whose various gradation values have been changed within the predetermined range (for example ±1 of gradation value) and generates image data for printing patches of predetermined area for each ink amount data. This image data will be delivered to the half-tone processing module 33, and patches will be printed by the processing of the half-tone processing module 33 and the printing processing module 34.

The color of the printed patches will be measured by a colorimeter 16 under the standard observation condition, and the verifying module 25 acquires the calorimetric value (color value) outputted by the colorimeter 16 (step S155). As a result, as the color value of each patch observed under the standard observation condition can be obtained, the color value of each patch and the color value of the specified color are compared. And the ink amount data outputting the patch nearest to the color value of the specified color are determined as the data to be correlated with the specified color (step S160).

Needless to say, as it is enough that ink amount data very close to the color value of the specified color can be extracted here, it is possible to adopt various structures such as setting the upper limit for the color difference for the comparison between the color value of the specified color and the color value measured, and when no ink amount data can be detected producing a color difference staying below the upper limit, resorting to another printing and measurement of the color of the patch by changing the ink amount data, or resorting to another evaluation by the evaluation index by changing the initial value and the like. The specified color profile generating module 26 generates data correlating the determined ink amount data and the specified color, and records the same as a specified color profile 41 in the hard disk 14 (step S165). As described above, in the present embodiment, the step S165 corresponds to the ink amount determining unit mentioned above.

As described above, the processing by the verifying module 25 enables to ensure that the ink amount data for printing the specified color would be specified even if the conversion precision of the model used by the printing model calculating module 22 above is not very precise. As the specified color profile 41 is generated by the processing described above, in the present embodiment, it is possible to obtain printed results that correctly reproduce the predetermined specified colors under the standard observation condition and whose color appearance hardly change even in the case of any change in the observation condition by printing based on the control of the printer driver 30.

(4) Printing Model

We will now describe an example of the printing model described above. The printing model described below is a model called "Cellular Yule-Nielsen Spectral Neugebauer Model." This model is based on the well-known Spectral Neugebauer Model and the Yule-Nielsen Model. Incidentally, in the following description the model in which three types of inks, i.e. CMY inks are used is described. It is easy to expand this model into a model in which a plurality of optional inks are used.

Figure 6:
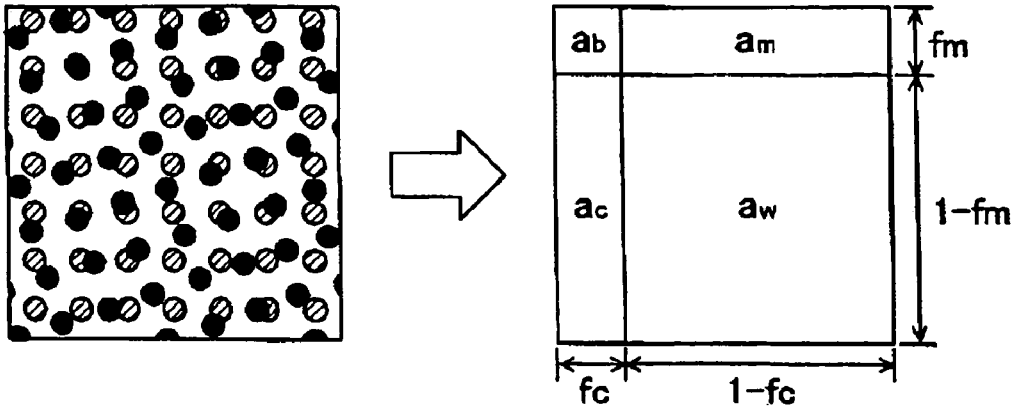
FIG. 6 is an illustration showing the Spectral Neugebauer Model.
Figure 6:
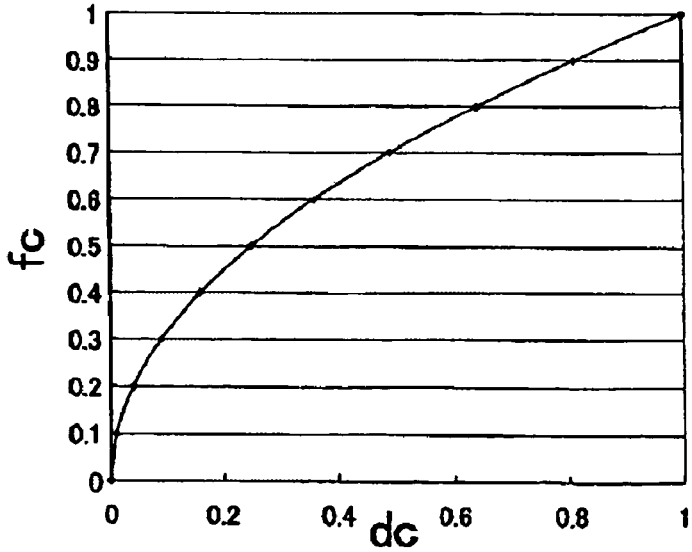

FIG. 6 is an illustration showing the Spectral Neugebauer Model (a model for calculating the spectral reflectance from the state of ink recording shown in the left side drawing of FIG. 6). In the Spectral Neugebauer Model, the spectral reflectance R(λ) of any optional printed matter is given by the following equation (3).

[Equation 3]

$$R(\lambda) = a_w R_w(\lambda) + a_c R_c(\lambda) + a_m R_m(\lambda) + a_y R_y(\lambda) + a_r R_r(\lambda) + a_g R_g(\lambda) + a_b R_b(\lambda) + a_k R_k(\lambda) \quad (3)$$

$$a_w = (1 - f_c)(1 - f_m)(1 - f_y)$$

$$a_c = f_c(1 - f_m)(1 - f_y)$$

$$a_m = (1 - f_c)f_m(1 - f_y)$$

$$a_y = (1 - f_c)(1 - f_m)f_y$$

$$a_r = (1 - f_c)f_m f_y$$

$$a_g = f_c(1 - f_m)f_y$$

$$a_b = f_c f_m(1 - f_y)$$

$$a_k = f_c f_m f_y$$

In this equation, ai represents the area ratio of the i'th area, and Ri(λ) represents the spectral reflectance of the i'th area.

The suffix i means respectively an area without ink (w), an area where only the cyan ink is recorded (c), an area where only the magenta ink is recorded (m), an area where only the yellow ink is recorded (y), an area where only the magenta ink and the yellow ink are recorded (r), and area where only the yellow ink and the cyan ink are recorded (g), an area where only the cyan ink and the magenta ink are recorded (b), and an area where the three inks CMY are recorded (k). And fc, fm, and fy represent the ratio of area covered by ink when only a type of the three inks CMY is discharged (called "ink covered area ratio"). The spectral reflectance Ri(λ) is obtained by measuring a color patch by a spectral reflectance meter.

The ink covered area ratio fc, fm and fy is given by the Murray-Davis Model shown in FIG. 6(B). In the Murray-Davis Model, for example the area ratio of the cyan ink fc is a nonlinear function of the discharge amount of the cyan ink and is given in the form of a primary look-up table. The reason why the ink covered area ratio is the nonlinear function of the ink discharge amount is that ink spread out widely when a small amount of ink is discharged, but on the other hand when a large amount of ink is discharged, ink overlaps and therefore the area covered by is does not increase very much.

The application of the Yule-Nielsen Model relating to the spectral reflectance results in the rewriting of the equation (3) mentioned above to the following equation (4a) or (4b).

[Equation 4]

$$R(\lambda)^{1/n} = a_w R_w(\lambda)^{1/n} + a_c R_c(\lambda)^{1/n} + a_m R_m(\lambda)^{1/n} + a_y R_y(\lambda)^{1/n} + a_r R_r(\lambda)^{1/n} + a_g R_g(\lambda)^{1/n} + a_b R_b(\lambda)^{1/n} + a_k R_k(\lambda)^{1/n} \tag{4a}$$

$$R(\lambda) = \{a_w R_w(\lambda)^{1/n} + a_c R_c(\lambda)^{1/n} + a_m R_m(\lambda)^{1/n} + a_y(R_y(\lambda)^{1/n} + a_r R_r(\lambda)^{1/n} + a_g R_g(\lambda)^{1/n} + a_b R_b(\lambda)^{1/n} + a_k(R_k(\lambda)^{1/n}\}^n \tag{4b}$$

In this equation, n represents a predetermined coefficient of 1 or more, and it can be set at n=10 for example. The equation (4a) and the equation (4b) are equations representing the Yule-Nielsen Spectral Neugebauer Model.

The Cellular Yule-Nielsen Spectral Neugebauer Model means the space formed by the ink covered area ratio according to the Yule-Nielsen Spectral Neugebauer Model described above split into a plurality of cells.

Figure 7:
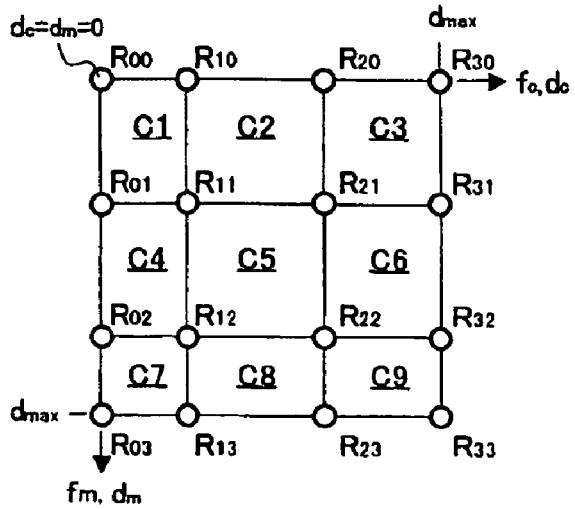
FIG. 7 is an illustration showing the Cellular Yule-Nielsen Spectral Neugebauer Model.
Figure 7:
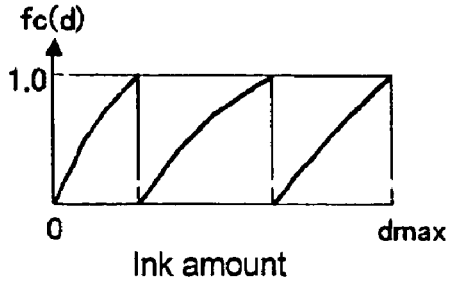
Figure 7:
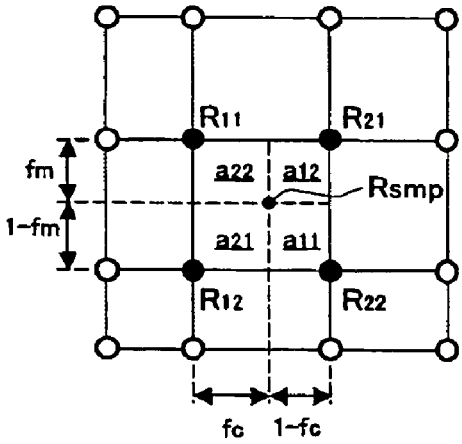

FIG. 7 (A) shows an example of splitting cells in the Cellular Yule-Nielsen Spectral Neugebauer Model. Here, for the purpose of simplification, the figure describes the splitting of cells in a two-dimensional space containing two axes including the cyan ink covered area ratio fc and the magenta ink covered area ratio fm. Incidentally, these axes fc and fm may be considered as axes representing the ink discharge amounts dc and dm. The white circles are the grid nodes (hereinafter referred to as "nodes") for cell splitting, and the two-dimensional space is split into nine cells C1-C9. The instances of spectral reflectance R00, R10, R20, R30, R01, R11 . . . R33 are predetermined respectively for the printed matters (color patches) at 16 nodes.

FIG. 7 (B) shows the shape of the ink covered area ratio fc(d) corresponding to this cell split. Here, the range 0-d max of the amount of one type of ink is split into three zones, and the ink covered area ratio fc(d) is represented by a curve that increases flatly from zero to 1 in each zone.

FIG. 7 (C) shows the method of calculating the spectral reflectance Rsmp (λ) of the samples in the central cell C5 of FIG. 7(A). The spectral reflectance Rsmp(λ) is given by the following equation (5).

[Equation 5]

$$\begin{aligned} Rsmp(\lambda) &= \left(\sum a_i R_i(\lambda)^{1/n}\right)^n \\ &= (a_{11}R_{11}(\lambda)^{1/n} + a_{12}R_{12}(\lambda)^{1/n} + a_{21}R_{21}(\lambda)^{1/n} + a_{22}R_{22}(\lambda)^{1/n})^n \end{aligned} \tag{5}$$

$$a_{11} = (1 - f_c)(1 - f_m)$$

$$a_{12} = (1 - f_c)f_m$$

$$a_{21} = f_c(1 - f_m)$$

$$a_{22} = f_c f_m$$

In this equation, the ink covered area ratios fc, fm are values given by the graph FIG. 7(B) and are values defined in this cell C5. And the values of spectral reflectance R11(λ), R12(λ), R21(λ), and R22(λ) at the four summits in the cell C5 are adjusted to give correctly the spectral reflectance Rsmp(λ) of the samples according to the equation (5) above. The splitting of the space formed by the ink covered area ratio into a plurality of cells in this way enables to calculate more precisely the spectral reflectance Rsmp(λ) of the samples as compared with the case of not splitting the space. Incidentally, it is preferable to set the values of nodes for the splitting of the cell independently for each ink color.

Figure 8:
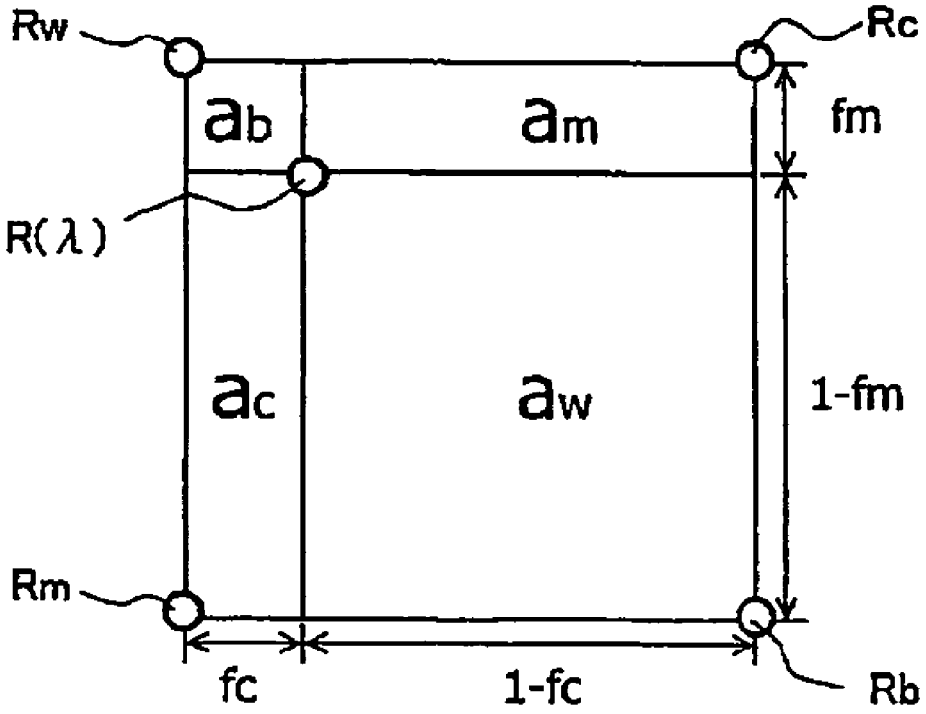
FIG. 8 is an illustration showing the method of calculating immeasurable spectral reflectance in the Cellular Yule-Nielsen Spectral Neugebauer Model.

Incidentally, in the model shown in FIG. 7(A), the spectral reflectance at all the nodes cannot normally be obtained by the measurement of color patches. The reason is that the discharge of a large quantity of ink leads to ink blurs and no uniform color patches can be printed. FIG. 8 shows the method of calculating immeasurable spectral reflectance. This shows the case of using only two types of ink, cyan and magenta. The spectral reflectance of any optional color patch printed by two types of ink, cyan and magenta R(λ) is given by the following equation (6).

[Equation 6]

$$R(\lambda)^{1/n}_{1/n} = a_w R_w(\lambda)^{1/n} + a_c R_c(\lambda)^{1/n} + a_m R_m(\lambda)^{1/n} + a_b R_b(\lambda) \tag{6}$$

$$a_w = (1 - f_c)(1 - f_m)$$

$$a_c = f_c(1 - f_m)$$

$$a_m = (1 - f_c)f_m$$

$$a_b = f_c f_m$$

Suppose that only the spectral reflectance Rb(λ) at the time when both the cyan ink and the magenta ink represent 100% discharged ink amount among a plurality of parameters contained in the above equation (6) is unknown and the values of other parameters are known. At this time, if the equation (6) is modified, the following equation (7) can be obtained.

[Equation 7]

$$R_b(\lambda) = \left\{\frac{R(\lambda)^{1/n} - a_w R_w(\lambda)^{1/n} - a_c R_c(\lambda)^{1/n} - a_m R_m(\lambda)^{1/n}}{a_b}\right\}^n \tag{7}$$

As described above, all the terms on the right side are known. Therefore, the unknown spectral reflectance Rb(λ) can be calculated by solving the equation (7).

The spectral reflectance of secondary colors other than the secondary colors cyan and magenta can be calculated in the same way. And when the spectral reflectance of a plurality of secondary colors has been calculated, the spectral reflectance of a plurality of tertiary colors can be calculated likewise. By thus calculating spectral reflectance of successively higher order, it is possible to calculate the entire spectral reflectance at all the nodes of the space formed by the ink covered area ratio split into cells.

The printing model calculating module 22 shown in FIG. 1 has the spectral reflectance values at various nodes in the space formed by the ink covered area ratio split into cells as FIG. 7(A) shows, and a primary look-up table showing the ink covered area ratio shown in FIG. 7(B), and is structured to calculate the spectral reflectance Rsmp(λ) for any optional ink amount data by using these. In addition, it has data showing the spectral distribution and the color matching function of any optional light source, calculates the tristimulus value by adding the product of multiplying the spectral reflectance Rsmp(λ) for each wave length, and acquires the color value by converting this tristimulus value by the known equation.

(5) Other Embodiments

The above embodiment is an example, and a variety of structures can be adopted as long as the ink amount data can be determined based on the first evaluation index for evaluating the color difference under the standard observation condition and the second evaluation index for evaluating the color difference under a plurality of observation conditions. For example, the computer for determining the ink amount and the computer for controlling printing may be separate computers. In the present embodiment, the manufacturer of the printer 15 may generate the specified color profile 41 in the manufacturing process of the printer 15 and provide the same simultaneously with the printer driver 30. According to this structure, a user not owning a calorimeter 16 can execute printing based on the specified color profile generated by the invention.

And the above printer 15 could load six ink colors of CMYKlclm. Needless to say, however, DY (dark yellow) may be added to increase the number of colors, and the number of colors may be reduced by choosing not to use lclm. And other colors, for example R (red) and V (violet) may be added to enable six ink colors of CMYKRV to be loaded.

And the specified color profile 41 may be structured as a profile correlated with a plurality of specified colors and ink amount data, and may be used as a color conversion table for converting not only the specified colors but optional colors. In other words, if there is any profile correlating a plurality of specified colors and the ink amount data, any optional colors may be converted into the ink amount data by executing interpolating calculations by referring this profile.

When the ink amount data for any optional inputted colors are calculated and printed by referring a profile generated in this way, the degree of concordance between any optional inputted colors and the printed results depends on the precision of interpolation. However, as the ink amount data correlated with the specified colors are data outputted with little variation due to changes in the observation conditions, for the ink amount data corresponding to any optional inputted color calculated based on these ink amount data also printing may be done with little variation in color due to changes in the observation conditions.

Obviously, in this structure, it is possible to generate a color conversion table by correlating a plurality of the predetermined specified colors and the ink amount data corresponding to these specified colors. It is also possible to generate a table correlating colors corresponding to the coordinate values uniformly arranged in the color space and the other desired colors with the ink amount data by further executing an interpolating calculation based on this color conversion table so that the printer driver 30 may utilize the same.

And the above-mentioned evaluation index E is an example, and if the data for printing the specified colors has no problem in terms of graininess or the limit of ink amount, any or both of GI and DI may be omitted. And, if the precision of conversion by the printing model calculating module 22 mentioned above is sufficiently high, the processing of the verifying module 25 may be omitted. And in the case where it is not necessary to limit the number of correction by the ink amount correcting module 24, and it is likely that the evaluation index E would fall below the threshold value Th with a relatively limited number of corrections, the determination of the initial value by the initial value determining module 21 may be omitted, and any optional ink amount data or the predetermined ink amount data may be adopted as the initial value for processing.

What is claimed is:

1. An ink amount determining method for correlating specified colors and ink amount comprising:

acquiring the specified color data showing the color values of the specified colors, converting the ink amount data showing any optional ink amount to color values, acquiring evaluation index including the first evaluation index for evaluating the color difference between the color values of the specified colors and the color value of the ink amount under the standard observation condition and the second evaluation index for evaluating the color difference among the color values obtained under a plurality of observation conditions with regards to the ink amount, evaluating whether the evaluation by the evaluation index meets the predetermined evaluation standard or not, and repeating the conversion of the ink amount data and acquisition of the evaluation index by correcting the ink amount until the evaluation standard is met, and correlating the ink amount data of the ink amount having met the evaluation standard and the specified color data.

2. The ink amount determining method according to claim 1 wherein the evaluation index includes any one of or both the graininess index for evaluating graininess in case printing is executed by the ink amount and the ink amount limit index for evaluating whether the ink amount limit is met or not when the predetermined printing medium is printed by the ink amount.

3. The ink amount determining method according to claim 1 wherein the first evaluation index contributes more than the second evaluation index to the evaluation result by the evaluation index.

4. The ink amount determining method according to claim 1 wherein the contribution of the first evaluation index to the evaluation result by the evaluation index gradually increases as the number of correction of the ink amount increases.

5. The ink amount determining method according to claim 1 wherein the printing apparatus prints patches based on the correlated ink amount data and a plurality of ink amount data in which the ink amount shown by the correlated ink amount data has been changed by the predetermined amount, the colorimetric value of the patches obtained is acquired, the acquired colorimetric value and the color value of the specified color are compared, and the ink amount data constituting the closest calorimetric value to the color value of the specified color are acquired.

6. The ink amount determining method according to claim 1 wherein data showing the predetermined areas containing the color value of the specified colors predetermined in color spaces not depending on equipment are acquired, a plurality of ink amount data are converted into color values, the color value closest to the color value of the specified colors in the predetermined area is specified from among these color values, the ink amount data giving this color value is acquired as the initial value, and the evaluation by the evaluation index is executed.

7. The ink amount determining method according to claim 1 wherein, in the case where the specified color data of the specified colors are to be acquired, the specified color data of the predetermined plurality of specified colors are acquired, the plurality of specified colors and ink amount data are correlated to generate color conversion profile data showing the correlation between the two.

8. An ink amount determining apparatus for correlating the specified colors and ink amount comprising;

a specified color data acquiring unit for acquiring the specified color data showing the color value of the specified colors, an ink amount data converting unit for converting the ink amount data showing any optional ink amount into color values, an evaluation index acquiring unit for acquiring evaluation index including the first evaluation index for evaluating the color difference between the color value of the specified colors and the color value of the ink amount under the standard observation condition and the second evaluation index for evaluating the color difference among the color values obtained under a plurality of observation conditions regarding the ink amount, an ink amount correcting unit for evaluating whether the evaluation by the evaluation index meets the predetermined evaluation standard or not, and repeat the conversion by the ink amount data converting unit and the acquisition of evaluation index by the evaluation index acquiring unit by correcting the ink amount until the evaluation standard is met, and and ink amount determining unit for correlating the ink amount data of the ink amount having met the evaluation standard and the specified color data.

9. An ink amount determining program product for correlating the specified colors and ink amount making the computer execute;

a specified color data acquiring program code for acquiring specified color data showing the color value of the specified colors, an ink amount data conversion program code for converting ink amount data showing any optional ink amount into color values, an evaluation index acquiring program code for acquiring evaluation index including the first evaluation index for evaluating the color difference between the specified colors and the color value of the ink amount under the standard observation conditions and the second evaluation index for evaluating the color difference among color values obtained under a plurality of observation conditions regarding the ink amount, an ink amount correcting program code for evaluating whether the evaluation by the evaluation index meets the predetermined evaluation standard or not, and repeat the conversion of the ink amount data and the acquisition of evaluation index by correcting the ink amount until the evaluation standard is met, and an ink amount determining program code for correlating the ink amount data of the ink amount having met the evaluation standard and the specified color data.

10. A print controlling apparatus for executing the printing of the specified colors comprising;

an image data acquiring unit for acquiring image data showing images containing the specified colors, a color converting unit for converting the image data into ink amount data by referring the predetermined profile, and a print controlling unit for executing printing based on the acquired ink amount data, and wherein the correlation between the specified color data showing the specified colors and the ink amount data in the profile includes;

acquiring evaluation index including the first evaluation index for evaluating the color difference between the color value of the specified colors and the color value under the standard observation condition obtained by converting the ink amount data and the second evaluation index for evaluating the color difference among color values under a plurality of observation conditions obtained by converting the ink amount data, evaluating whether the evaluation by the evaluation index meets the predetermined evaluation standard or not, and repeating the acquisition of the evaluation index by correcting the ink amount until the evaluation standard is met, and and correlating the ink amount data of the ink amount having met the evaluation standard and the specified color data.

11. A print controlling method for executing the printing of the specified colors comprising;

acquiring the image data showing images including the specified colors, converting the image data into ink amount data by referring a predetermined profile, wherein for printing based on the acquired ink amount data, the correlation between the specified color data showing the specified colors and the ink amount data in the profile includes;

acquiring evaluation index including the first evaluation index for evaluating the color difference between the color value of the specified colors and the color value under the standard observation condition obtained by converting the ink amount data and the second evaluation index for evaluating the color difference among color values under a plurality of observation conditions obtained by converting the ink amount data, evaluating whether the evaluation by the evaluation index meets the predetermined evaluation standard or not, and repeating the acquisition of the evaluation index by correcting the ink amount until the evaluation standard is met, and and correlating the ink amount data of the ink amount having met the evaluation standard and the specified color data.

12. A print controlling program product for printing the specified colors comprising;

an image data acquiring program code for acquiring image data showing images containing the specified colors, a color converting program code for converting the image data into ink amount data by referring a predetermined profile, wherein for having the computer execute the print controlling program code to print based on the acquired ink amount data, the correlation between the specified color data showing the specified colors and the ink amount data in the profile includes;

acquiring evaluation index including the first evaluation index for evaluating the color difference between the color value of the specified colors and the color value under the standard observation condition obtained by converting the ink amount data and the second evaluation index for evaluating the color difference among color values under a plurality of observation conditions obtained by converting the ink amount data, evaluating whether the evaluation by the evaluation index meets the predetermined evaluation standard or not, and repeating the acquisition of the evaluation index by correcting the ink amount until the evaluation standard is met, and and correlating the ink amount data of the ink amount having met the evaluation standard and the specified color data.

* * * * *